US005875982A

United States Patent [19]

Underberg

[11] Patent Number: 5,875,982

[45] Date of Patent: Mar. 2, 1999

[54] REFINER HAVING CENTER RING WITH REPLACEABLE VANES

[75] Inventor: Wesley J. Underberg, Mequon, Wis.

[73] Assignee: J & L Fiber Services, Inc., Waukesha, Wis.

[21] Appl. No.: 968,673

[22] Filed: Nov. 12, 1997

Related U.S. Application Data

[63] Continuation of Ser. No. 703,320, Aug. 26, 1996, abandoned.

[51] Int. Cl.[6] ..... B02C 7/02; B02C 7/12

[52] U.S. Cl. ..... 241/261.3; 241/298

[58] Field of Search ..... 241/247, 261.2, 241/298, 188.2

[56] References Cited

U.S. PATENT DOCUMENTS

| | | | |
|---|---|---|---|
| 1,947,953 | 2/1934 | Otto | 241/188.2 |
| 2,507,507 | 5/1950 | Egedal | 241/261.2 X |
| 2,931,586 | 4/1960 | Messing . | |
| 3,062,457 | 11/1962 | Willems | 241/188.2 |
| 3,170,649 | 2/1965 | Fisher | 241/298 |
| 3,880,368 | 4/1975 | Matthew . | |
| 4,005,827 | 2/1977 | Frair et al. . | |
| 4,011,027 | 3/1977 | Selder . | |
| 4,036,443 | 7/1977 | Saltarelli . | |
| 4,081,146 | 3/1978 | Yagi | 241/247 X |
| 4,253,613 | 3/1981 | Reinhall | 241/16 |
| 4,529,137 | 7/1985 | Matthew et al. . | |
| 4,531,681 | 7/1985 | Matthew et al. . | |
| 4,570,862 | 2/1986 | Kirchner . | |
| 4,586,662 | 5/1986 | Goldenberg et al. . | |
| 4,610,400 | 9/1986 | Sjobom | 241/261.2 |
| 4,614,309 | 9/1986 | Goldenberg . | |
| 4,619,414 | 10/1986 | Kirchner et al. . | |
| 4,620,675 | 11/1986 | Kirchner . | |
| 4,625,926 | 12/1986 | Kirchner . | |
| 5,046,672 | 9/1991 | Demler . | |
| 5,165,592 | 11/1992 | Wasikowski . | |
| 5,178,339 | 1/1993 | Pilao . | |
| 5,203,514 | 4/1993 | Mokvist et al. . | |
| 5,509,610 | 4/1996 | Gibbons et al. | 241/37 |

FOREIGN PATENT DOCUMENTS

| | | |
|---|---|---|
| WO 95/25199 | 9/1995 | European Pat. Off. . |
| 2457701 A1 | 12/1974 | Germany . |

*Primary Examiner*—John M. Husar
*Attorney, Agent, or Firm*—Nilles & Nilles, S.C.

[57] ABSTRACT

An improved high-consistency disc refiner employs a central ring or flinger nut. The radial vanes mounted on the flinger nut are releasably mounted to the flinger nut base in which keyways are milled. Matching keys on the bottom of the flinger nut vanes position the vanes in the keyways. The flinger nut vanes are held in position by bolts which extend through bolt holes which are parallel to the axis of rotation of the rotor and which are threadedly engaged with the flinger nut base.

34 Claims, 2 Drawing Sheets

REFINER HAVING CENTER RING WITH REPLACEABLE VANES

This application is a continuation of application Ser. No. 08/703,320 filed on Aug. 26, 1996 now abandoned.

FIELD OF THE INVENTION

This invention relates in general to refiners which prepare paper pulp fibers prior to their being delivered to a papermaking machine, and in particular to high density disc refiners.

BACKGROUND OF THE INVENTION

During the production of fibers for paper making, wood or another fiber source is ground into chips and/or mechanically treated such that the chips may be broken down further and refined into individual fibers.

Disc refiners are used with high density stock containing forty to sixty percent fiber by weight to break down clumps of fibers into individual fibers. Disc refiners are also used with low density, low consistency pulp of two to five percent fiber dry weight to increase the freeness or bonding capability of the individual fibers.

The refiner disc consists of a disc-shaped steel or steel-alloy casting which has a multiplicity of more-or-more less radially extending bars cast on the surface thereof. One disc is mounted on a rotor for rotation and another disc is held opposed to the first refiner disc, either by rigid mounting or by mounting on an opposing rotating rotor. The refiner discs, as they move past each other, separate and refine the wood pulp as it passes between the opposed discs.

A refiner for high density stock employs an auger which is axially mounted with respect to the rotor on which the refining disks are mounted. Positioned adjacent to the end of the auger is a flinger nut which feeds the stock into a breaker bar section which in turn feeds the stock to the refiner disks where wood chips and clumps of fiber are broken down into individual fibers. Conventional flinger nuts employ radially extending vanes which become worn, necessitating expensive replacement of the flinger nut.

In the manufacture of paper, the cost of the stock or wood fibers used to manufacture the paper is the single largest component in the cost of the paper made. The paper fibers or stock is manufactured from wood chips which are in many aspects an industrial commodity whose price is governed by the market and not easily controlled. Thus, in improving the cost and efficiency of the papermaking process, it is important to focus on reducing the cost of processing the wood chips to produce the stock or furnish from which the paper is made. High density refiners which are used principally with mechanical or semi-chemical pulps are subjected to an intense wear environment. The wood chips which are fed to the refiner can contain sand and grit, which in the environment of the high density stock can produce relatively rapid ware.

What is needed is a flinger nut which can be efficiently maintained for improved wear life.

SUMMARY OF THE INVENTION

The improved high-consistency disc refiner of this invention employs a central ring or flinger nut, wherein radial vanes are releasably mounted to the flinger nut base.

A typical disc refiner employs a rotor mounted on a central axis within a housing. Stock enters the housing and is moved along the axis of the rotor by an auger. Mounted on the face of the rotor, facing the auger, is the central ring or flinger nut of the refiner. The job of the flinger nut is to initiate the radial acceleration of the high consistency stock along a radial plane defined by the rotor. As the stock moves along the rotor plane, the refiner discs mounted on the rotor and oppositely mounted fixed or counter-rotating refiner discs mounted on the housing break up and refine the wood chips and fiber clumps contained in the high-density stock.

In the process of papermaking, where wood in the form of logs is converted into fibers for the manufacture of paper, efforts are constantly made to remove foreign materials from the wood chips and fiber. This is done both to prevent these foreign materials from being incorporated in the finished product and also to prevent the damage that foreign materials cause to the pulp processing equipment. However, in the production of mechanical or semi-chemical pulp where the wood chips are mechanically treated prior to their complete dissolution into individual fibers, it is impossible to remove all sand and dirt which becomes attached or imbedded in the wood chip feed stock. The result is that the mechanical handling of wood chips necessarily results in the abrasion of the equipment employed.

The flinger nut of this invention has a base in which keyways are milled. Matching keys on the bottom of the flinger nut vanes position the vanes in the keyways on the flinger nut base. The flinger nut vanes are held in position by bolts which extend through bolt holes which are parallel to the axis of rotation of the rotor and which pass through the flinger nut vanes and are threadedly engaged with the flinger nut base. Because the flinger nut is often fabricated as a single, integral component, the normal procedure of replacing the entire nut requires extensive disassembly of the refiner, which can result in excessive down time.

The flinger nut of this invention, by employing replaceable vanes, not only reduces the cost of maintenance by allowing the replacement of only a part of the flinger nut, but generally also allow replacement of the vanes without removal of a flinger nut base. This reduces maintenance time and the costs associated with the unavailability of the refiner.

It is a feature of the present invention to provide a refiner employing a flinger nut with reduced maintenance costs.

It is a feature of the present invention to provide a refiner employing a flinger nut which improves the availability of the refiner.

It is a further feature of the present to provide a refiner employing a flinger nut of greater wear life.

Further features and advantages of the invention will be apparent from the following description when taken in conjunction with the accompanying drawings.

DESCRIPTION OF THE PREFERRED EMBODIMENT

Figure 1:
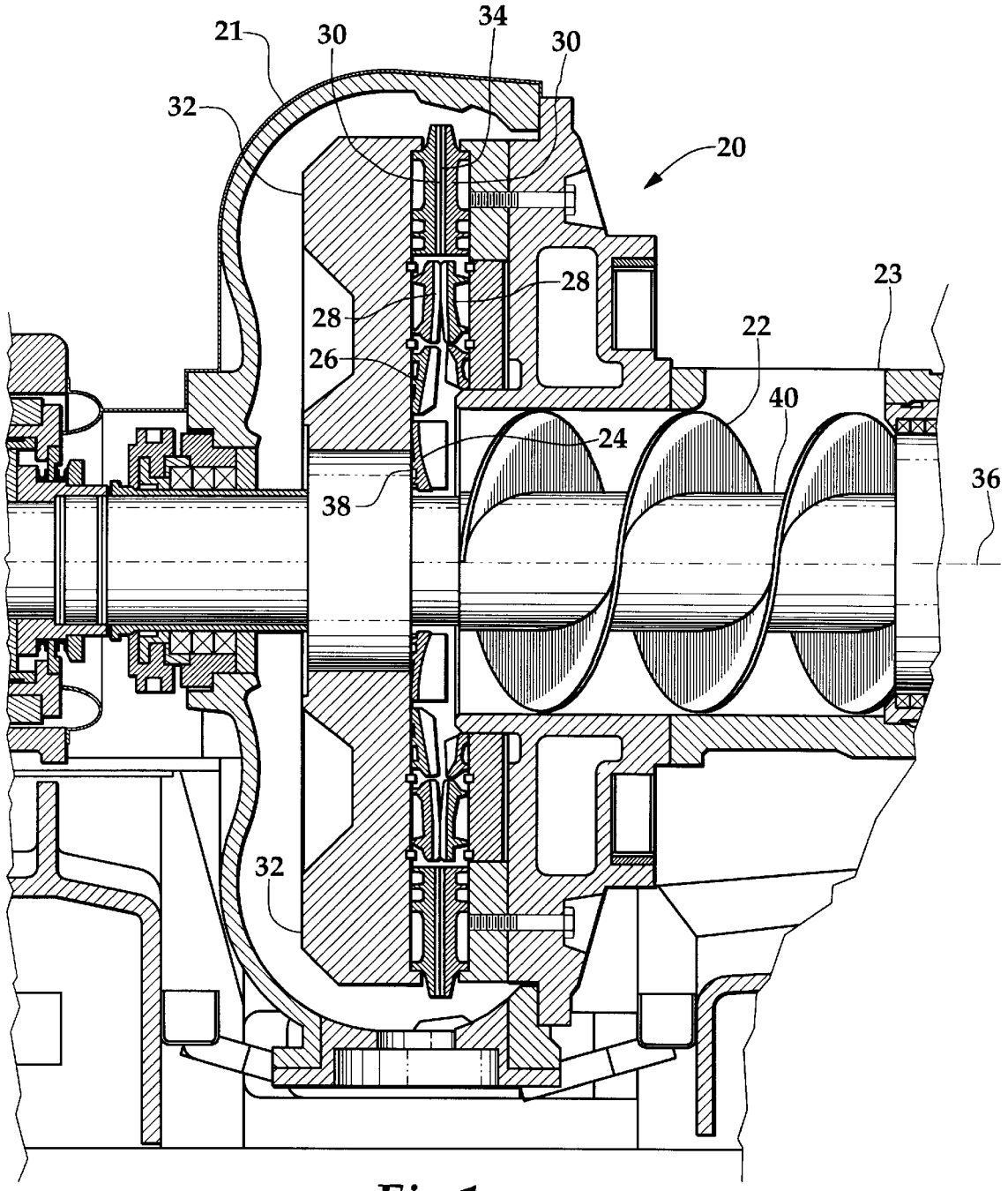
FIG. 1 is a fragmentary cross-sectional view of a high-density stock disc refiner which is employed with the flinger nut of this invention.
Figure 2:
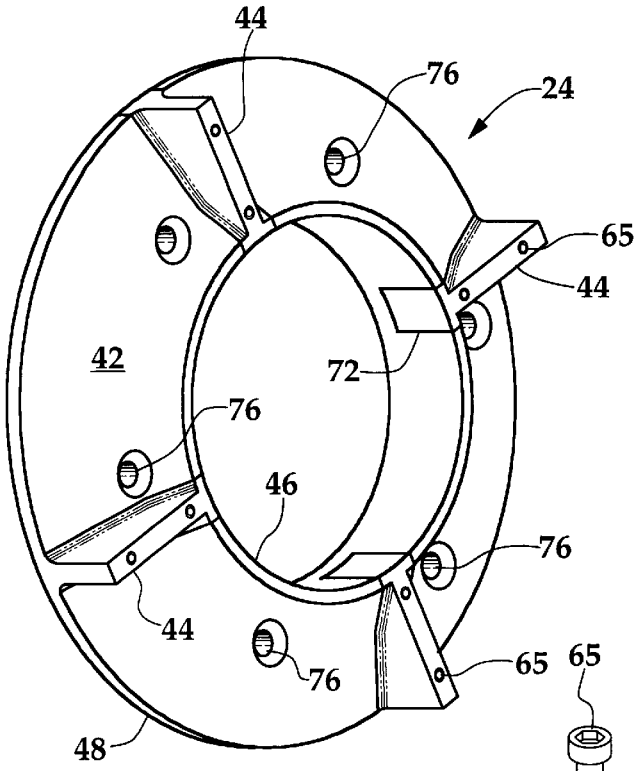
FIG. 2 is an isometric view of the flinger nut with replaceable vanes of this invention.
Figure 3:
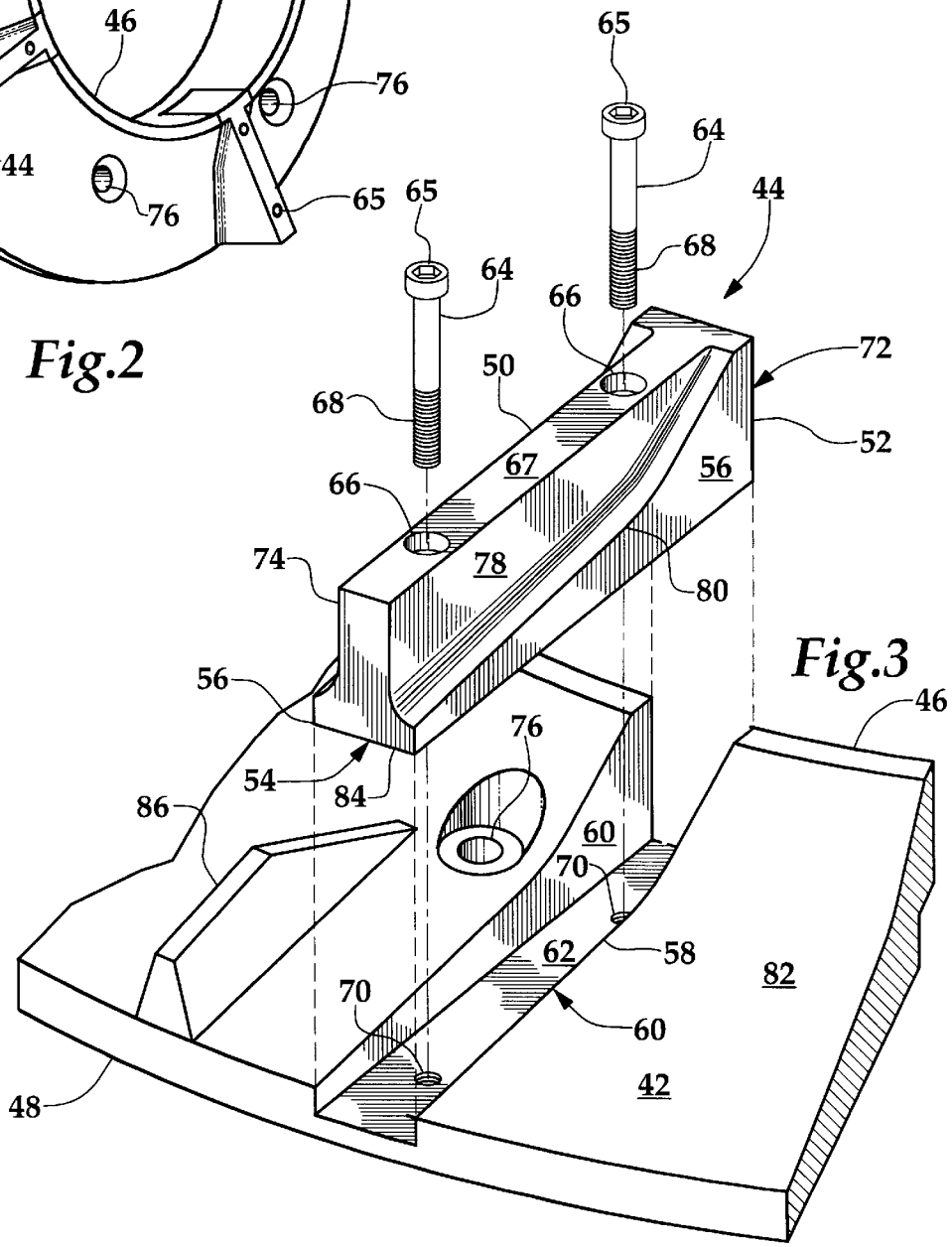
FIG. 3 is a fragmentary exploded isometric view of the flinger nut of FIG. 2.

Referring more particularly to FIGS. 1–3, wherein like numbers refer to similar parts, a high-density pulp refiner 20 employing a releasably-mounted-vane flinger nut 24 is shown in FIG. 1. The refiner 20 has a housing 21 with an auger 22 mounted therein which supplies a high consistency pulp or stock from a stock inlet 23. Wood chip feed typically consists of forty to sixty percent wood chips and wood fiber in a medium of water. The auger 22 supplies stock to a center ring or flinger nut 24. The flinger nut 24 in turn passes the chips and fibers to a breaker bar section 26. The breaker bar section 26 leads into first refiner discs 28 and second refiner discs 30. The refiner discs are mounted to a rotor 32 parallel to a radially extending plane 34. The rotor 32 and refining discs 28, 30 rotate about an axis 36.

The auger 22 of the disc refiner 20 is mounted about the central axis 36 about which the rotor 32 rotates. The auger 22 moves high consistency pulp and wood chips from the stock inlet 23 to the central face 38 of the rotor 32. The auger 22 is disposed about a central shaft 40 which abuts the central face 38. Mounted on the central face 38 of the rotor 32, facing the auger 22, is the flinger nut 24 of the refiner 20. The flinger nut 24 initiates the radial acceleration of the high consistency stock along the radial plane 34 defined by the rotor 32. As the stock moves along the radial plane 34, the refiner discs 28, 30 mounted on the rotor 32 and on the housing 21 break up and refine the wood chip and fiber clumps contained in the high density stock.

The flinger nut 24 is composed of an annular base section 42, best shown in FIG. 2, to which are mounted four radially extending and axially protruding vanes 44. The base section 42 has a surface 82 which is approximately frustoconical, with the base section being thicker toward the central axis than away from it. The vanes 44 are spaced at equal angles from one another and extend from the inner circumference 46 to the outer circumference 48 of the base section 42.

Each vane 44, as shown in FIG. 3, is formed with a protruding key section 52 which is releasably mounted to the base section 42 by a key and keyway arrangement. Each vane key section 52 has a lower surface 54 and radially extending side surfaces 56 which are perpendicular to the radial plane. The key section 52 fits within a keyway 58 formed by portions of the base section 42. The keyway 58 has two side surfaces 60 which abut the side surfaces 56 of the key section 52 of the vane 44. The keyway 58 also has a bottom surface 62 which extends between the keyway side surfaces 60 and which engages the bottom surface 54 of the key section 52. Bolts 64 extend through bolt holes 66 in the vane 44. The bolts have threads 68 which are engaged with threaded holes 70 in the keyway bottom surface 62 of the base section 42. The key portion 52 of the vane 44 has a radiused inner circumferential surface 72 which forms part of the inner cylindrical circumference 46 of the flinger nut 24. The inner surface 72 is closely spaced from or abuts the central shaft 40 as shown in FIG. 1.

The vane bolt holes 66 are counter-sunk so that the bolt heads 65 are recessed below the upper surface 67 of the protruding blade 50 of the vane 44. The vane 44 has an outer radiused circumferential surface 74. The flinger nut 24 base section 42 is mounted to the rotor 32 around the central face 38 by bolts (not shown) which pass through holes 76 in the base section 42.

As it rotates, the motion of the flinger nut causes wood chips and wood fibers to press up against the sides 78 of the protruding vane blade 50. To prevent material from becoming jammed between the vane side surface 78 and the key surface 80 which generally conforms to the upper surface 82 of the base section 42 of the flinger nut 24, a curved transition section 84 extends between the key surface 80 and the surface 82 of the base section 42.

In the process of papermaking, where wood chips made from logs or wood wastes are converted into fibers for the manufacture of paper, efforts are constantly made throughout the manufacturing process to remove foreign materials from the wood chips and fibers. This is done both to prevent these foreign materials from being incorporated in the finished paper and to prevent the foreign materials from causing damage to the pulp processing equipment. However, where wood chips are processed, as in the high-density refiner 20, a certain amount of sand and dirt is invariably imbedded in the wood chips. Thus the feed stock supplied to a high-density refiner 20 necessarily creates an abrasive environment for the components of the refiner 20.

In practice, the vanes 44 of the flinger nut 24 experience wear which reduces their efficiency and necessitates periodic replacement. By employing replaceable flinger nut vanes 44, the cost of replacement parts due to flinger nut vane wear is reduced, since only the vanes and not the entire flinger nut 24 must be replaced. A second advantage is that where prior art flinger nuts were generally formed as a continuous section, the replacement of which requires more extensive disassembly of the refiner 20, the present invention allows replacement of the vanes alone. Vane replacement can generally be done without removing the flinger nut from the central shaft 40.

A third advantage is that the vanes 44 can be of varying types and configurations. Thus, they can be optimized more readily by the cost-effective trial of a number of vane designs. Further, in some circumstances, it may be advantageous to employ different vanes with different types of feed stock.

As shown in FIG. 3, secondary vanes 86 may be positioned between the vanes 44. The secondary vanes, while not essential, can improve the through-put of the flinger nut 24. There may be one, two or more secondary vanes 86 between the primary vanes 44. The secondary vanes may be welded in place as they will not necessarily wear as fast as the primary vanes 44. Alternatively, the secondary vanes may be attached by bolts (not shown) in a manner similar to the vanes 44.

It should be understood that the invention is not limited to the particular construction and arrangement of parts herein illustrated and described, but embraces such modified forms thereof as come within the scope of the following claims.

I claim:

1. A refiner for wood chips and wood fibers comprising:

a housing having a stock inlet;

a rotor mounted for rotation about a central axis within the housing;

at least one refiner plate mounted on the rotor for refining papermaking stock; and a flinger nut having a base section mounted on the rotor and at least one radially extending vane releasably mounted to the base section, the vane projecting axially from the base section and extending radially along the base section; and wherein the base section comprises a keyway and the vane comprises a key that is received in the keyway.

2. The refiner of claim 1 wherein the key engages the base section within the keyway.

3. The refiner of claim 1 wherein the releasable mounting employs at least one bolt passing through the vane and into the base.

4. The refiner of claim 1 wherein at least four vanes are releasably connected to the base section.

5. The refiner of claim 4 wherein the vanes are equally angularly spaced about the central axis.

6. The refiner of claim 1 further comprising at least one secondary vane member positioned on the base section, wherein the secondary vane member projects axially and extends radially less than the vane.

7. A flinger nut for use within a wood chip and wood pulp refiner, the flinger nut comprising:

annular base section attachable to a rotor and having portions defining a plurality of recessed radially extending keyways; and a vane releasably engaged within each keyway, wherein each vane has an outwardly protruding blade member which engages material introduced to the flinger nut, and a key section which extends beneath the blade and is releasably connected to the base section within a keyway; wherein each vane is selectably removable from the base section.

8. The flinger nut of claim 7 further comprising at least one threaded fastener which extends through a vane and engages with the base section to releasably connect the vane to the base section.

9. The flinger nut of claim 7 further wherein the base section has at least one secondary vane which extends axially from the base section and spaced from a keyway.

10. The flinger nut of claim 9 wherein the at least one secondary vane is immovably fixed to the base section.

11. The flinger nut of claim 10 wherein the at least one secondary vane is welded to the base section.

12. The flinger nut of claim 9 wherein the at least one secondary vane has a length in a radial direction relative to the base section that is less than the length of the releasably engaged vane and a height in an axial direction relative to the base section that is less than the height of the releasably engaged vane.

13. The flinger nut of claim 7 wherein the key section has a width and a length and the blade member has a width and a length and the width of the key section is greater than the width of at least a portion of the blade member.

14. The flinger nut of claim 7 comprising a pair of the threaded fasteners releasably connecting the vane to the base section, wherein the pair of the fasteners are spaced apart in a radial direction relative to the base section.

15. In a refiner for use with wood chips and wood fibers having a housing with a stock inlet, a rotor mounted for rotation about a central axis within the housing, and at least one refiner plate mounted on the rotor for refining papermaking stock, wherein the improvement comprises:

a flinger nut mounted within the housing and located radially inwardly of the refiner plate, the flinger nut having a) an annular base section mounted to the rotor, b) a plurality of angularly spaced vanes which extend axially from the base section, wherein the vanes are releasably connected to the base section such that each of the releasably connected vanes are removable and replaceable, and c) a secondary vane of lesser axial and radial extent spaced between the releasably fastened vanes.

16. The refiner of claim 15 wherein the releasable mounting employs at least one bolt passing through the vane and into the base.

17. The refiner of claim 16 wherein the base section has a plurality of angularly spaced slots wherein each of the releasably connected vanes are received in one of the slots.

18. A flinger nut for use within a wood chip and wood pulp refiner, the flinger nut comprising:

an annular base section attachable to a rotor and having a frustoconical upper surface, the annular base section further having a portion defining a recessed radially extending keyway;

a vane releasably engaged within each keyway, wherein each vane has as outwardly protruding blade member which engages material introduced to the flinger nut and a key section which extends beneath the blade and is releasably connected to the keyway of the base section, wherein the protruding blade member has sides, and wherein the key section has a surface which substantially conforms to the upper surface of the base section; and a curved transition surface extending between the surface of the key section and the upper surface of the base section, such that when the vane is engaged within the recess, and the flinger nut causes wood chips and wood fibers to impact the sides of the protruding blade member, the curved transition surface prevents any material from becoming jammed between the sides of the blade member and the key surface.

19. A refiner for wood chips and wood fibers comprising:

a housing having a stock inlet;

a rotor mounted for rotation about a central axis within the housing;

at least one refiner plate mounted on the rotor for refining papermaking stock; and a flinger nut having a base section mounted on the rotor with at least one radially extending vane releasably mounted to the base section, the vane projecting axially from the base section and extending radially along the base section, and at least one secondary member positioned on the base section, wherein the secondary vane member projects axially and extends radially less than the vane.

20. In a refiner for use with wood chips and wood fibers having a housing with a stock inlet, a rotor mounted for rotation about a central axis within the housing, and at least one refiner plate mounted on the rotor for refining papermaking stock, wherein the improvement comprises:

a flinger nut mounted within the housing and located radially inwardly of the refiner plate, the flinger nut having an annular base section mounted to the rotor and a plurality of angularly spaced vanes which extend axially from the base section, wherein the vanes are each releasably received in a slot in the base section and each releasably attached to the base section by a plurality of spaced apart fasteners.

21. The refiner of claim 20 wherein each of the fasteners comprises a bolt having a threaded portion that extends through an axial bore in the blade and threadably engages the base section.

22. The refiner of claim 20 wherein the base section has an inner radial periphery and an outer radial periphery wherein each slot extends from the inner radial periphery of the base section to the outer radial periphery of the base section.

23. A flinger nut removably mounted to a rotor of a refiner carried by a shaft having an axis about which the rotor and the flinger nut are rotated comprising:

an annular base section having an outer circumference and an inner circumference defining a circular bore through which the shaft extends, wherein the annular base section is thicker adjacent the inner circumference than adjacent the outer circumference and has a plurality of pairs of circumferentially spaced and radially extending slots therein;

a plurality of pairs of vanes that each have 1) a radially extending key section that is received in one of the slots in the base section, and 2) a radially extending blade that extends axially from the key section outwardly of the base section, and wherein when the key section is thicker adjacent the inner circumference of the base section than adjacent the outer circumference of the base section; and wherein the vanes are each removably attached to the base section by a plurality of spaced apart fasteners.

24. The flinger nut of claim 23 wherein the base section has a generally circular axially outermost upper surface about the inner circumference and the blade of the vane has a portion of an axially outermost upper surface that is substantially flush with the upper surface of the base section when the vane is received in one of the slots.

25. The flinger nut of claim 24 wherein the upper surface of the blade is generally T-shaped.

26. The flinger nut of claim 24 wherein the thickness of the base section of the flinger nut increases from adjacent the outer circumference of the base section to adjacent the inner circumference of the base section and the thickness of the key section of the vane increases from adjacent the outer circumference of the base section to adjacent the inner circumference of the base section.

27. The flinger nut of claim 24 wherein the upper surface of the blade has a 1) a circumferentially extending portion adjacent the inner circumference of the base section, and 2) a radially extending portion.

28. The flinger nut of claim 27 wherein the key section is wider than the radially extending portion of the upper surface of the blade.

29. The flinger nut of claim 27 wherein the bore in the base section is further defined by an inner circumferential surface having a radius and each of the vanes have a radiused inner circumferential surface that is substantially flush with the inner circumferential surface of the base section when the key section of the vane is received in one of the slots.

30. The flinger nut of claim 23 wherein the thickness of the base section increases from adjacent the outer circumference of the base section to adjacent the inner circumference of the base section and the thickness of the key section increases from adjacent the outer circumference of the base section to adjacent the inner circumference of the base section.

31. The flinger nut of claim 30 wherein the key section has an upper surface (80) that is flush with the upper surface (82) of the base section when the vane is received in one of the slots in the base section.

32. The flinger nut of claim 30 wherein each of the slots in the base section are defined by a pair of spaced apart radially extending side surfaces and a bottom surface thereby defining a keyway in the base section, and the key section of each of the vanes comprises a pair of spaced apart side surfaces and a bottom surface, wherein one of the side surfaces of the key section abut against the one of the side surfaces of the keyway and the other of the side surfaces of the key section abut against the other of the surfaces of the keyway when the key section is received in the keyway.

33. The flinger nut of claim 32 wherein the bottom surface of the key section engages the bottom surface of the keyway when the key section is received in the keyway.

34. The flinger nut of claim 32 wherein the keyway extends from the inner circumference of the base section to the outer circumference of the base section.

* * * * *